United States Patent [19]

Keefe

[11] 4,038,725

[45] Aug. 2, 1977

[54] FASTENER AND METHOD OF USING SAME

[75] Inventor: Jack D. Keefe, Dayton, Ohio

[73] Assignee: Monarch Marking Systems, Inc., Dayton, Ohio

[21] Appl. No.: 673,771

[22] Filed: Apr. 5, 1976

Related U.S. Application Data

[63] Continuation-in-part of Ser. No. 560,433, March 20, 1975, Pat. No. 3,973,229.

[51] Int. Cl.[2] ..... B65D 63/16

[52] U.S. Cl. ..... 24/150 FP; 292/322

[58] Field of Search ..... 24/16 PB, 30.5 P, 206 A, 24/208 A, 150 FP, 255 BS, 30.5 R, 30.5 S, 73 PF, 90 W, 90 PR; 292/318, 307, 321, 322 , 325; 40/21 R, 21 C; 283/18, 20

[56] References Cited

U.S. PATENT DOCUMENTS

| | | | |
|---|---|---|---|
| 3,001,254 | 9/1961 | Schumm | 24/30.5 PB |
| 3,402,435 | 9/1968 | Merser | 24/16 PB |
| 3,973,299 | 8/1976 | Keefe | 24/150 FP |

*Primary Examiner*—G. V. Larkin

*Attorney, Agent, or Firm*—Joseph J. Grass

[57] ABSTRACT

There are disclosed three embodiments of a fastener, a method of using a fastener, and a fragmentary portion of a mold. The fastener has a socket and a head joined by a flexible filament. The socket has a disc-shaped body, a transverse opening through the body, projections extending into the opening, and a post joined to each projection. The posts extend into the space within a side wall of the opening. The projections flex when the head is inserted through the opening, but the posts prevent attempted withdrawal of the head through the opening thereby preventing uncoupling of the head from the socket. The projections are so close that when the head is inserted into the socket, some of the plastics polymeric material of the projections deforms permanently, thereby work hardening the projections at the deformation. One of the fasteners has a head, a pair of relatively rigid sockets, a flexible hinge connecting the sockets to each other, and a flexible filament connecting the head and the pair of sockets. The one socket nests in the other socket when the sockets are moved to a position in which the socket openings are aligned. According to the method of use, the socket openings are moved generally into alignment and the head is inserted through both socket openings.

10 Claims, 17 Drawing Figures

FASTENER AND METHOD OF USING SAME

CROSS-REFERENCE TO RELATED APPLICATION

This is a continuation-in-part of application Ser. No. 560,433, filed Mar. 20, 1975, now U.S. Pat. No. 3,973,229 granted Aug. 10, 1976.

BACKGROUND OF THE INVENTION

1. Field of the Invention

This invention relates to the field of fasteners and to methods of using same.

2. Brief Description of the Prior Art

The following U.S. patents disclose fasteners, each having a socket, projection extending into an opening in the socket and a post or end which is used to prevent withdrawal of the body portion or strap portion from the socket:

| Patentee | Pat. No. | Issued |
|---|---|---|
| Geisinger | 3,339,246 | Sept. 5, 1967 |
| Geisinger | 3,590,442 | July 6, 1971 |
| Waddington | 3,735,448 | May 29, 1973 |

The following U.S. patents disclose fasteners, each having a socket and a head joined by a filament:

| Patentee | Pat. No. | Issued |
|---|---|---|
| Merser | 3,402,435 | Sept. 24, 1968 |
| Merser | 3,462,802 | Aug. 26, 1969 |
| Merser et al | 3,816,879 | June 18, 1974 |

The following patents disclose fasteners in which a head passes through more than one opening in the fastener:

| Patentee | Pat. No. | Issued |
|---|---|---|
| Fuhrmann | U.S 2,314,779 | March 23, 1943 |
| Toepfer | U.S. 2,961,785 | Nov. 29, 1960 |
| Laguerre | French 1,228,128 | Feb. 12, 1962 |
| Potter et al | French 1,468,568 | Dec. 26, 1966 |

SUMMARY OF THE INVENTION

This invention relates to a one-piece fastener composed of molded, polymeric, plastics material having a head, a pair of relatively rigid sockets, a flexible hinge connecting the sockets to each other, and a flexible filament connecting the head and the pair of sockets, with each socket having an opening, and the sockets being movable from a position in which the openings are out of alignment to a position wherein the openings are generally aligned. The head is insertable through both sockets while the sockets are generally aligned. It is preferred that the one socket has a wall within which the other socket is received when the sockets are in the position in which the socket openings are generally aligned. Each socket preferably has a generally disc-shaped body with the opening in each socket extending generally transversely through the respective body, with each opening having a side wall, and a plurality of projections joined at their respective bases to each body adjacent the respective side wall and extending into the respective transverse opening. It is preferred that one or more of the projections have posts adjacent the side wall to prevent withdrawal of the head from the sockets. According to the method of using the fastener, the sockets are moved relative to each other about the hinge to bring the socket openings generally into alignment, and the head is inserted through both socket openings.

DETAILED DESCRIPTION OF THE PREFERRED EMBODIMENTS

Figures 1, 2, 3, 4, 5, 6, 7, 8, 9, 10, 11, 12, 13:
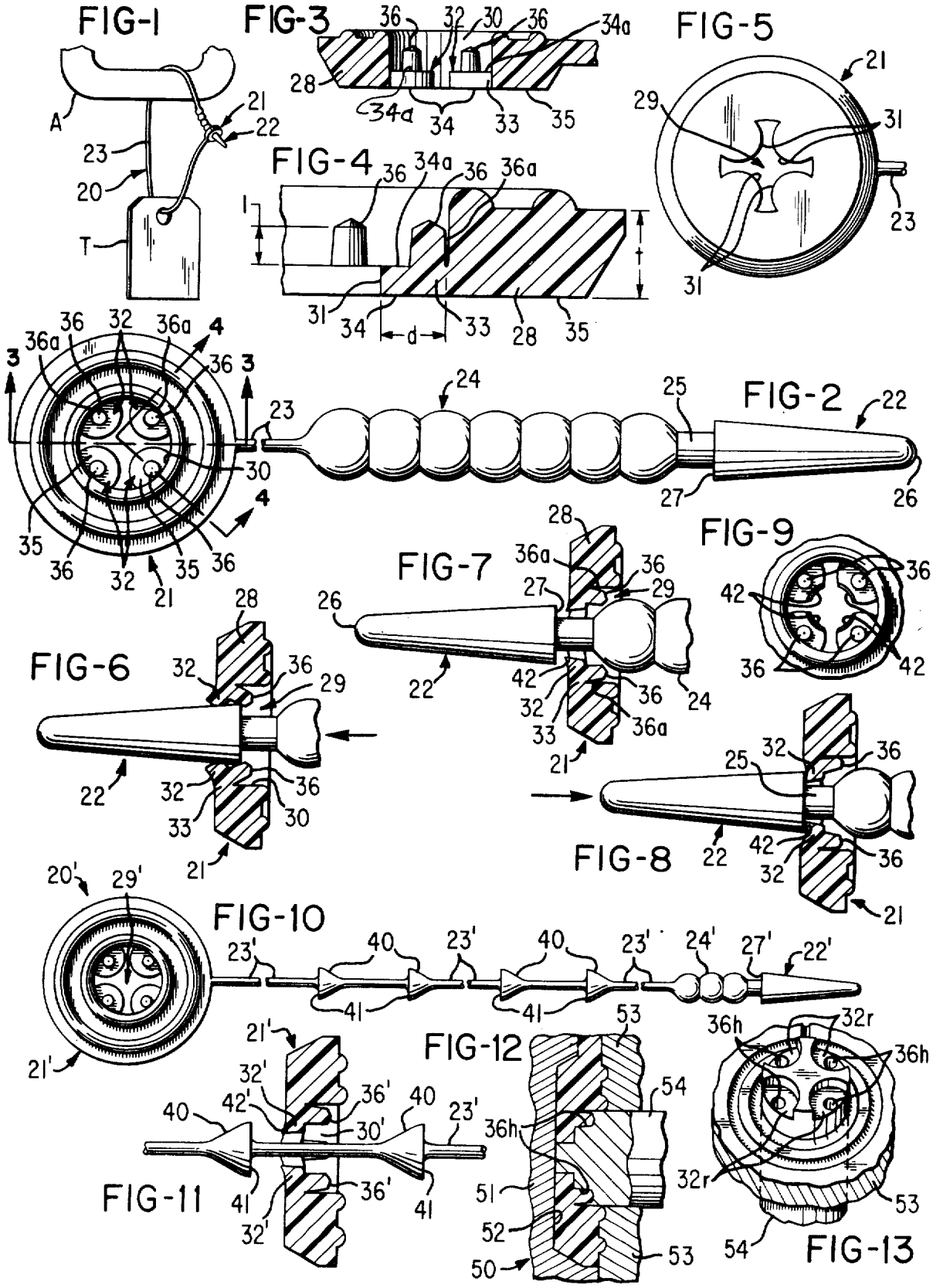
FIG. 1 is a perspective view of a fastener in accordance with the invention used to attach a tag to an article.
FIG. 2 is an enlarged fragmentary view of the fastener.
FIG. 3 is a sectional view taken along line 3—3 of FIG. 2.
FIG. 4 is a sectional view taken along line 4—4 of FIG. 2.
FIG. 5 is a view of the opposite side of a socket of the fastener from that shown in FIG. 2.
FIG. 6 is a fragmentary view of the fastener, showing the head being inserted into the socket.
FIG. 7 is a view similar to FIG. 6, but showing the head as having been inserted through the socket, thereby effecting coupling of the head and the socket.
FIG. 8 is a view similar to FIG. 7, but showing attempted removal of the head from the socket.
FIG. 9 is a fragmentary view of the sides of the socket depicting permanent deformation of the projections effected by insertion of the head into the socket.
FIG. 10 is a fragmentary view of an alternative form of the invention, on a somewhat reduced scale from that used in FIGS. 2 through 9.
FIG. 11 is an enlarged fragmentary view showing the fastener in the coupled position in which at least one of the ratchet teeth has passed through the socket.
FIG. 12 is a sectional view of fragmentary portions of a pair of mold sections and a core pin for molding the fasteners.
FIG. 13 is a fragmentary perspective view of the core pin and one of the mold sections.
Figure 14:
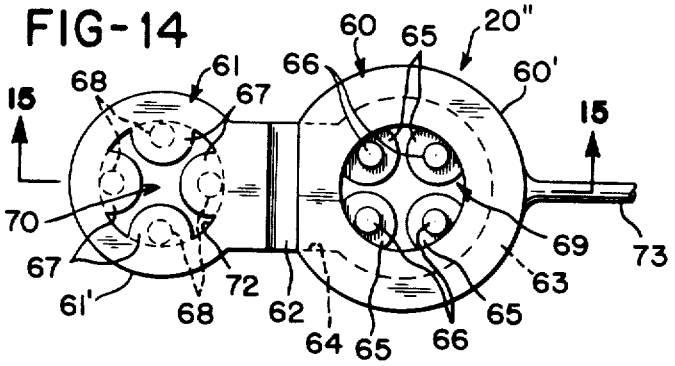
FIG. 14 is a fragmentary view showing a pair of sockets interconnected by a hinge and a portion of a filament.
Figure 16:
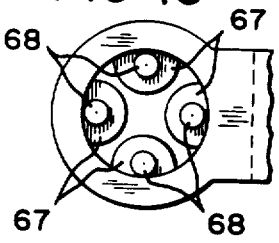
FIG. 16 is a view taken along line 16—16 of FIG. 15.
Figure 15:
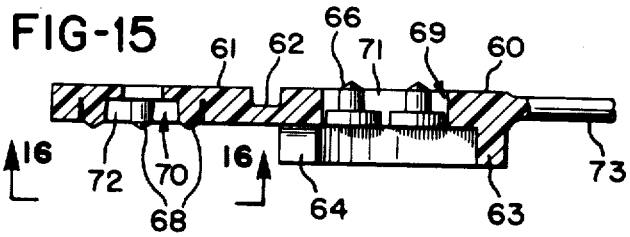
FIG. 15 is a sectional view taken along line 15—15 of FIG. 14.

With reference to FIG. 1, there is shown a loop type fastener generally indicated at 20 being used to attach a tag T to an aritcle A, although it is readily apparent that the fastener 20 has a variety of other uses as well. With reference now also to FIGS. 2 through 9, the fastener 20 includes a socket generally indicated at 21, a head generally indicated at 22, and a filament 23 connected to the socket 21 at one end. A relatively stiff roughened manually graspable section generally indicated at 24 is connected to the other end of the filament 23 to a neck 25 which is in turn connected to the head 22. The neck 25 is shown to be circular in section, and the head 22 is shown to be generally conical and to converge generally to its rounded free end 26. The other end of the head 22 terminates at an annular shoulder 27. The section 24, the neck 25, the head 22, and the filament 23 all have the same axis.

The socket 21 preferably has a generally disc-shaped body 28 which is preferably relatively thin, unlike the socket body disclosed in U.S. Pat. No. 3,590,442 which has an elongated or tubular shape. Thinness of the body 28 means that the materials costs can be kept to a minimum. The socket 21 has a short through-opening generally indicated at 29 which is considered to extend in the transverse direction. The shortness of the opening 29 means that socket 21 can be easily released from the mold. The opening 29 is comprised by a side wall 30. The diameter of the section 24 is too large to pass through the opening 29 as is evident from the drawngs, especially FIGS. 7 and 8. The projections 32 are joined to the body 28 at their bases 33. The bases 33 of the projections are sufficiently small in section to flex to allow the head 22 to pass through the socket opening 29 as shown in FIG. 6 to the position shown in FIG. 7. As the head 22 passes through the socket opening 29, the posts 36 move inwardly away from the side wall 30 as the projections 32 flex. If the posts 36 are long enough to contact head 22 as the projections 32 flex and posts 36 move inwardly, the posts 36 can flex slightly to permit the passage of the head 22 completely through the socket opening 29, whereupon the projections snap in behind the shoulder 27 of the head 22. The projections 32 are shown to extend inwardly. The projections 32 are shown to comprise lobes, the outer peripheries 31 of which are shown to be circular in FIGS. 2 and 5. The individual projections 32 are shown to be spaced-apart so that they will flex independently. The one sides 34 of the projections 32 lie in a common flat plane with one side 35 of the body 28, as seen in FIGS. 3, 4 and 5. The other sides 34a of the projections 32 lie in a common flat plane parallel to the plane in which sides 34 and 35 lie. Although it is preferred to have four projections 32 in the illustrated embodiment, a greater number such as five or a lesser number such as two or three can be provided.

It is preferred that each projection 32 has a post or stop 36 formed integrally therewith and extending from surface 34*a*. The projections 32 are shown to be column-shaped. The axis of each projection 32 is preferably generally parallel to the side wall 30. More particularly, the posts 36 converge slightly to their free ends as best shown in FIG. 4. This aids in removal of the fastener 20 from the mold. It is preferred that the sides 36*a* of the posts 36 be closely adjacent the side wall 30. If an attempt is made to uncouple the head 22 from the socket 21, the sides 36*a* of the posts 36 are urged into abutment with the side wall 30 as best shown in FIG. 8. It is readily apparent that the loop formed by coupling the head 22 with the socket 21 cannot be undone without destroying the fastener 20.

With reference to FIGS. 10 and 11, there is shown an alternative form of fastener 20′ which is identical to the fastener 20, except that its filament 23′ has a plurality of substantially equally spaced-apart generally cone-shaped ratchet elements or teeth 40 disposed along its length. While the fastener 20′ is capable of being coupled by engagement of head 22′ with socket 21′ in the same manner as the fastener 20, section 24′ is small enough so that it will pass readily through opening 29′. The section 24′ is preferably no larger in diameter and most preferably smaller in diameter than the maximum diameter of the head 22′, which maximum diameter exists adjacent shoulder 27′ in the illustrated embodiment. If it is desired to draw the coupled fastener 20′ into a smaller loop, the section 24′ is passed through the opening and the section 24′ and/or the head 22′ can be grasped to draw one or more teeth 40 through the opening 29′. The teeth 40 each have a maximum diameter adjacent their respective annular shoulders which is the same or substantially the same as the maximum diameter of the head 22′ so that once any tooth 40 has passed through the opening as shown in FIG. 10, that tooth cannot be withdrawn due primarily to posts 36′ which cooperate with side wall 30′.

As shown in FIGS. 6 through 9 for the fastener 20 and in FIG. 11 for the fastener 20′, the projections 32 and 32′, respectively, are shown to be permanently deformed. The permanent deformation takes place when the heads 22 and 22′ pass through respective sockets 21 and 21′. As this occurs, the plastics material of which the fastener is composed work hardens and toughens to inhibit withdrawal of the head 22 of the fastener 20 or the head 22′ and teeth 40 of the fastener 20′. Deformation occurs because the plastics material of which the projections 32 and 32′ are composed is compressed and respective permanent ridges or protrusions 42 and 42′ result.

With reference to FIGS. 12 and 13, there is shown a fragmentary portion of a simplified drawing of a mold generally indicated at 50 in which fastener 20 for example can be molded in an injection molding machine. One mold part 51 has a cavity 52 of a relatively simple configuration and the other mold part 53 is fitted with a core pin 54. With reference also to FIG. 13, the core pin 54 includes a plurality of recesses 32r for forming projections 32. The portion of the core pin between the recesses 32r is cross-shaped and forms the cross-shaped gap between the projections 32 as best shown in FIGS. 2 and 5. The recesses 32*r* are simply formed by a rotary milling cutter and hence outer peripheries 31 of the projections 32 will be circular. The posts 36 are simply formed by drilling the core pin 54 with a slightly tapered drill to form holes 36*h*. The core pin 54 is considerably simpler to make than the core pins of certain prior art molds. This is important in that the mold 50 can be of the 100 cavity type in which 100 such core pins are required.

Figure 17:
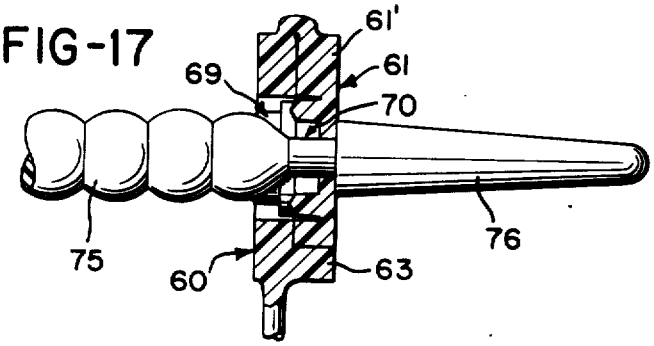
FIG. 17 is a view showing the sockets and hinge in section and showing the head to which the filament is connected.

With reference to the embodiment of FIGS. 14 through 17, there is shown a one-piece fastener 20″ having a pair of sockets 60 and 61 connected by a flexible integrally molded hinge or weakened portion 62. Both sockets 60 and 61 have generally disc-shaped bodies 60′ and 61′ but the outside dimensions of socket 60 are greater than those of the socket 61. The socket 60 has a wall 63 with an opening 64. The inside configuration of wall 63 corresponds generally to the outside configuration of the socket 61. The sockets 60 and 61 are relatively rigid because they are relatively heavy or large in section but the hinge 62 is relatively flexible because it is light or small in section. Thus, the sections 60 and 61 can be moved relative to each other about the hinge 62 to the position shown in FIG. 17. In this position the sockets 60 and 61 are shown to be in abutting face-to-face relationship and in contact with each other, and the socket 61 is nested in the socket 60 in the space within the side wall 63. In this position the sockets 60 and 61 are shown to be generally parallel to each other. In the as-molded condition shown in FIGS. 14 and 15 the sockets 60 and 61 lie generally in the same plane, but movement of the sockets 60 and 61 through about 180° to the position shown in FIG. 17 is practical because of the flexibility of the hinge 62.

The socket 60 has projections 65 and posts 66, and the socket 61 has projections 67 and posts 68 corresponding in construction, function and relative location to the projections 32 and posts 36 as shown in the embodiment of FIGS. 1 through 9. In like manner, sockets 60 and 61 have respective openings 69 and 70 with respective side walls 71 and 72. As shown, the projections 65 and respective posts 66 of socket 60 and the projections 67 and respective posts 68 of socket 61 are shown to be out of radial alignment with each other, specifically but without limitation about 45°.

A filament 73 is connected at one end to the socket 60 and at its other end to manually graspable section 75 (shown in part in FIG. 17) but corresponding to section 24'. The section 75 is in turn connected to head 76. While the filament 73 is connected to the socket 60, it can alternately be connected to the socket 61 or to the hinge 62. In use, the sockets 60 and 61 are first moved relative to each other from the position shown for example in FIG. 14 to the position shown in FIG. 17 and thereupon the head 76 can be inserted through both openings 69 and 70 to the position shown in FIG. 17, thereby forming a loop as depicted in FIG. 1.

The fasteners 20, 20' and 20" are composed of a suitable flexible, molded, polymeric, thermoplastic, plastics material. While nylon is the preferred material due to its flexibility, other materials such as polypropylene can be used. If the fasteners 20, 20' and 20" are desired to be used as-molded, that is, unstretched, then polyethylene is also a satisfactory material from which they can be molded.

By way of example, not limitation, the outer diameter of the socket bodies 28 and 61' is about 0.296 inch, each annular opening provided by side walls 30, 71 and 72 has a diameter of about 0.125 inch, the projections 32, 65 and 67 have a radius of curvature of about 0.031, the distance d of the outer peripheries 31 of a projection to the side wall 30 is about 0.0456 inch (and the same applies to projections 65 and 67 and respective side walls 71 and 72), the projections 32, 65 and 67 are about 0.015 inch thick, the length 1 of each post 36, 66 and 68 is about 0.025 inch, and the thickness t of each socket 21, 60 (not including wall 63) and 61 is about 0.040 inch.

Other embodiments and modifications of this invention will suggest themselves to those skilled in the art, and all such of these as come within the spirit of this invention are included within its scope as best defined by the appended claims.

I claim:

1. A one-piece fastener composed of molded, polymeric, plastics material, the fastener comprising: a head, a pair of relatively rigid sockets, a flexible hinge connecting the sockets to each other, and a flexible filament connecting the head and the pair of sockets, each socket having an opening, the sockets being movable from a position in which the openings are out of alignment to a position wherein the socket openings are generally aligned, the head being insertable through both socket openings while the sockets are generally aligned.

2. A one-piece fastener as defined in claim 1, wherein one socket is provided with a wall within which the other socket is received when the sockets are in the position in which the socket openings are generally aligned.

3. A one-piece fastener as defined in claim 1, wherein each socket has a generally disc-shaped body, the opening in each socket extending generally transversely through the respective body, each opening having a side wall, and a plurality of projections joined at their respective bases to each body adjacent the respective side wall and extending into the respective transverse opening.

4. A one-piece fastener as defined in claim 1, wherein each socket has a generally disc-shaped body, the opening in each socket extending generally transversely through the respective body, each opening having a side wall, a plurality of projections joined at their respective bases to each body adjacent the respective side wall and extending into the respective transverse opening, and a post joined to at least one projection of at least one of the sockets, the post extending into the space within the respective side wall, the post having a side closely adjacent the respective side wall, the bases of the projections being sufficiently small in section to enable the projections to flex as the head is inserted through the respective opening to effect coupling of the head, the side of the post being urged into contact with the side wall upon attempted withdrawal of the head thereby preventing uncoupling of the head.

5. A one-piece fastener as defined in claim 1, wherein the sockets are disposed in face-to-face abutting contact when the openings are generally aligned.

6. A one-piece fastener composed of molded, polymeric, plastics material, the fastener comprising: a head, a pair of relatively rigid first and second sockets, a flexible hinge connecting the first and second sockets to each other, and a flexible filament connecting the head and the pair of sockets, each socket having an opening, means defining a recess in the first socket for receiving the second socket in nested relationship, the sockets being movable from a position in which the first and second sockets lie generally in a plane to another position in which the second socket is nested in the first socket.

7. A one-piece fastener as defined in claim 6, wherein each socket has a generally disc-shaped body, the opening in each socket extending generally transversely through the respective body, each opening having a side wall, a plurality of projections joined at their respective bases to each body adjacent the respective side wall and extending into the respective transverse opening, and a post joined to at least one projection of each socket, the post extending into the space within the respective side wall, the post having a side closely adjacent the respective side wall, the bases of these projections being sufficiently small in section to enable the projections to flex as the head is inserted through the respective opening to effect coupling of the head, the side of at least one post being urged into contact with the side wall upon attempted withdrawal of the head.

8. A one-piece fastener as defined in claim 7, wherein the post or posts of the first socket are out of radial alignment with the post or posts of the second socket when the second socket is nested in the first socket.

9. Method of using a one-piece fastener composed of molded, polymeric, plastics material and having a head, a pair of relatively rigid sockets, a flexible hinge connecting the sockets to each other, and a flexible filament connecting the head and the pair of sockets, the sockets being initially in generally the same plane, each socket having an opening, comprising the steps of: moving the sockets relative to each other about the hinge to bring the socket openings generally into alignment, and inserting the head through both socket openings.

10. Method of using a one-piece fastener composed of molded, polymeric, plastics material and having a head, a pair of first and second relatively rigid sockets, a flexible hinge connecting the sockets to each other, and a flexible filament connecting the head and the pair of sockets, means defining a recess in the first socket for receiving the second socket in nested relationship, the sockets being initially in generally the same plane, each socket having an opening, comprising the steps of: moving the sockets relative to each other about the hinge to bring the second socket into nested relationship in the first socket and to bring the socket openings generally into alignment, and inserting the head through both socket openings.

* * * * *